United States Patent [19]

Landa et al.

[11] Patent Number: 4,525,248

[45] Date of Patent: Jun. 25, 1985

[54] PROCESS FOR THE ELECTROLYTIC DEPOSITION OF LAYERS OF NICKEL ALLOYS

[75] Inventors: Vaclav Landa, Hrusicka; Jaromir Vitek, Prague, both of Czechoslovakia

[73] Assignee: Stani vyzkumny ustav materoalu, Prague, Czechoslovakia

[21] Appl. No.: 498,957

[22] Filed: May 27, 1983

Related U.S. Application Data

[63] Continuation-in-part of Ser. No. 242,636, Mar. 11, 1981, abandoned.

[30] Foreign Application Priority Data

Jun. 18, 1980 [CS] Czechoslovakia ..... 4292-80

[51] Int. Cl.[3] ..... C25D 5/34; C25D 3/56

[52] U.S. Cl. ..... 204/29; 204/32.1; 204/44.5; 204/44.7

[58] Field of Search ..... 204/29, 32 R, 43 T, 204/43 P, 44.5, 44.7

[56] References Cited

FOREIGN PATENT DOCUMENTS 2033429 5/1980 United Kingdom ..... 204/43 T

OTHER PUBLICATIONS

A. Kenneth Graham, *Electroplating Engineering Handbook* 3rd Edition, 1971, pp. 190–211.

*Primary Examiner*—G. L. Kaplan
*Assistant Examiner*—W. T. Leader

[57] ABSTRACT

A process of electrolytic deposition of layers of nickel alloys, especially nickel alloyed with molybdenum, with tungsten, and with phosphorus, from an electrolyte on the basis of sulphosalicylate. The object to be coated is degreased, rinsed with activation solution, for example with sulphosalicylic acid, is electrolytically activated with nickel (II) chloride solution, and coated in an electrolyte containing compounds of alloying elements, a halide, wetting agents, and a luster-forming admixture.

9 Claims, No Drawings

PROCESS FOR THE ELECTROLYTIC DEPOSITION OF LAYERS OF NICKEL ALLOYS

This application is a continuation-in-part of application Ser. No. 242,636, filed Mar. 11, 1981, now abandoned.

The invention is related to a process of electrolytic deposition of layers of nickel alloys, especially nickel alloyed with molybdenum, with tungsten, and with phosphorus, which improve the properties of electrolytically deposited thin to thick layers.

Up to now layers of nickel alloys, for example nickel alloyed with molybdenum, and nickel alloyed with tungsten, could not be successfully deposited. Layers of nickel alloyed with other elements are deposited from weakly acidic electrolytes on the basis of sulphates or from alkaline electrolytic baths containing ammonia and organic hydroxy-acids. Deposited layers of these alloys are characterized by their high stress value, which causes them to become brittle, and their adherence to the base material is insufficient. Their use in practice is thus problematic.

The drawbacks mentioned are eliminated by the process of electrolytic deposition of layers of nickel with alloying elements, especially with molybdenum, tungsten and phosphorus, according to the invention, carried out from an aqueous electrolyte on the basis of sulphosalicylate. In accordance with the invention, the object to be coated is degreased, and after degreasing is rinsed with an activation solution, for example with sulphosalicylic acid, and it is then electrolytically activated, for example in nickel (II) chloride solution. The sulphosalicylic acid activation solution may have a concentration between 0.1 to $1.5\times10^3$ mol.$^{-3}$. After rinsing, the object is coated in an electrolyte which contains salts or other compounds of alloying elements in the range between 0.-01 and $0.25\times10^3$ mmol.m$^{-3}$ and ionic and/or non-ionic wetting agents, for example sodium laurysulphate in a concentration between 0.002 and $0.04\times10^3$ mol.m$^{-3}$, and a luster-forming admixture, for example saccharin, coumarin or p-toluene sulphonamide in a concentration between 0.01 to 2.0 g/l. The electrolyte for metal plating may also contain a halide in an amount varying within the range of from 0.01 to $0.2\times10^3$ mol.m$^{-3}$.

Common technical materials, for example steels, copper and nickel alloys, can be coated by the process according to the invention. Thin to thick layers of nickel alloys can be formed on objects to be coated, which layers have a thickness between 0.5 μm and several milimeters. Such deposited layers are characterized by good adherence and mechanical properties, their micro-hardness is between 300 and 800 HM with a simultaneous low level of macrostress, which is 50 to 150 MPa (megapascal). The alloys mentioned can be used as functional galvanic layers on highly stressed machine parts exposed to erosive or abrasive wear. The deposited alloys are characterized by good corrosive resistance as well.

The process according to the invention is further disclosed in the following non-limiting examples:

EXAMPLE 1

A shaft of an electric motor with a minus diameter tolerance of 0.06 mm was degreased and then rinsed in 8% sulphosalicylic acid. The shaft was then activated at a temperature of 25° C. and then cathodically activated in nickel (II) chloride solution with a pH=2. Coating was carried out in an electrolyte containing $0.075\times10^3$ mol.m$^{-3}$ of nickel (II) sulphosalicylate, $0.75\times10^3$ mol.m$^{-3}$ disodium molybdate, $0.04\times10^3$ mol.m$^{-3}$ nickel (II)·bromide and 1.2 g/l of saccharin. A layer of alloying metal deposited at the average current density 7 A/dm$^2$ contained 2.4% of molybdenum. Its microhardness was 400 HM.

EXAMPLE 2

A braking cylinder after degreasing was rinsed in 5% fluoroboric acid at a temperature of 20° C. It was then electrolytically activated in nickel (II) chloride solution with a pH=2.5. The deposition of a nickel-tungsten alloy layer took place in an electrolyte with a composition of $0.70\times10^3$ mol.m$^{-3}$ of nickel (II) sulphosalicylic, $0.05\times10^3$ mol.m$^{-3}$ potassium iodide, $0.3\times10^3$ mol.m$^{-3}$ boric acid and $0.01\times10^3$ mol.m$^{-3}$ of disodium tungstate. A layer with a thickness of 15 μm was deposited at a cathodic current density 2.5 A/dm$^2$; such layer contained 3.1% tungsten. Its microhardness was 730 HM.

EXAMPLE 3

A steel plate after degreasing was rinsed in 8% sulphosalicylic acid. It was then activated at a temperature of 25° C., after which it was cathodically activated in nickel (II) chloride solution with a pH=2. The coating was carried out in an electrolyte containing $0.8\times10^3$ mol.m$^{-3}$ of nickel (II) sulphosalicylate, $0.05\times10^3$ mol.m$^{-3}$ phosphorus acid, $0.05\times10^3$ mol.m$^{-3}$ potassium bromide, 0.8 g/l saccharin, 0.1 g/l coumarin and 0.5 g/l of dipropylnaphtalene sulfonic acid. A layer with a thickness of 30 μm was deposited by the process described. Such layer was deposited at a cathode density of 4 A/dm$^2$. Its microhardness, which was 738 HM, increased to a value of 1020 HM after being heated to 450° C.

EXAMPLE 4

A bearing ring with a minus dimension tolerance of 0.1 mm was degreased and, after being rinsed in 10% sulphosalicylic acid, was activated at a temperature of 20° C. It was then cathodically activated in nickel (II) chloride solution with a pH=2.5, after which it was coated in electrolyte containing $0.71\times10^3$ mol.m$^{-3}$ of nickel (II) sulphosaicylate, $0.10\times10^3$ mol.m$^{-3}$ iron (II) sulphosalicylate, $0.05\times10^3$ mol.m$^{-3}$ potassium bromide , 0.5 g/l of p-toluene sulphonamide and 0.2 g/l of sodium laurylsulphate. A layer of alloys of nickel with iron with a thickness of 0.2 mm was deposited at an average cathodic current density of 6 A/dm$^2$; such layer contained 14.1% of iron. The bearing ring was then reground to the desired size, installed, and put into use.

Although the invention is illustrated and described with reference to a plurality of preferred embodiments thereof, it is to be expressly understood that it is in no way limited to the disclosure of such preferred embodiments but is capable of numerous modifications within the scope of the appended claims.

We claim:

1. A process of cathodic deposition of alloys selected from the group consisting of nickel/molybdenum, nickel/tungsten and nickel/phosphorus, the process comprising degreasing the surface of an object to be metal-plated, activating said surface by rinsing in a sulphosalicylic acid solution, and finally metal-plating said surface in an aqueous sulfo-salicylic acid electrolyte containing nickel as a major ingredient and substances selected from the group consisting of compounds of molybdenum, tungsten and phosphorus in concentrations varying within the range from 0.001 to $0.25\times10^3$ mol.m$^{-3}$.

2. A process as claimed in claim 1, wherein the electrolyte for metal-plating contains a halide in an amount varying within the range of from 0.01 to $0.2\times10^3$ mol.m$^{-3}$.

3. A process as claimed in claim 1, wherein the electrolyte for metal-plating contains gloss-forming agent selected from the group consisting of saccharin and p-toluene sulphonamide.

4. A process as claimed in claim 2, wherein the electrolyte for a metal-plating contains gloss-forming agent selected from the group consisting of saccharin and p-toluene sulphonamide.

5. A processes claimed in claim 1, wherein the electrolyte for metal-plating contains an ionic wetting agent.

6. A process as claimed in claim 1, wherein the electrolyte for metal-plating contains a non-ionic wetting agent.

7. A process of cathodic deposition of alloys selected from the group consisting of nickel/molybdenum, nickel/tungsten, and nickel/phosphorus, the process comprising degreasing the surface of an object to be metal-plated, activating said surface by rinsing in a sulphosalicylic acid solution and finally metal-plating said surface in an aqueous electrolyte substantially on the basis of nickel sulphosalicylate and substances selected from the group consisting of compounds of molybdenum, tungsten and phosphorus in concentrations varying within the range from 0.001 to $0.25\times10^3$ mol.m$^{-3}$.

8. A process as claimed in claim 7, wherein the concentration of the sulphosalicylic acid activating solution is between 0.1 to $1.5\times10^3$ mol.m$^{-3}$.

9. A process as claimed in claim 7, wherein subsequent to the step of activation in the sulphosalicylic acid solution the object is further activated by electrolytically processing said surface in an electrolyte containing aqueous solution of nickel chloride.

* * * * *